United States Patent [19]

Joyce

[11] 4,311,249

[45] Jan. 19, 1982

[54] CONTAINER WITH RELEASABLE CLOSURE

[76] Inventor: Michael F. Joyce, 25 Rangewood Ave., Kennet Valley, Reading, Berks. RG3 3NN, England

[21] Appl. No.: 62,780

[22] Filed: Aug. 1, 1979

[30] Foreign Application Priority Data

Aug. 4, 1978 [GB] United Kingdom ..... 32266/78

[51] Int. Cl.[3] ..... B65D 17/32

[52] U.S. Cl. ..... 220/268

[58] Field of Search ..... 220/268, 265–268; 215/253; 222/541, 478

[56] References Cited

U.S. PATENT DOCUMENTS

| | | | |
|---|---|---|---|
| 3,262,611 | 7/1966 | Palmer | 222/478 |
| 3,935,961 | 2/1976 | Bennett | 220/266 |
| 4,054,228 | 10/1977 | Balocca et al. | 220/268 |
| 4,105,134 | 8/1978 | DeLenham et al. | 220/268 |
| 4,128,186 | 12/1978 | Gane | 220/268 |
| 4,134,517 | 1/1979 | Rhoades | 220/268 |

*Primary Examiner*—George T. Hall

*Attorney, Agent, or Firm*—Charles W. Helzer

[57] ABSTRACT

A container comprising a sheet metal wall portion (a) having a closure formed therein, the closure comprising a slit (s) in said wall portion (a) the margins of which by cold working have been caused to overlap to provide overlapping surfaces (b), (g) which cooperate to close the container, the wall portion (a) being deformable by manual pressure on a part (c) thereof remote from the closure to move said overlapping surfaces (b), (g) apart to define an opening (q) therebetween.

24 Claims, 27 Drawing Figures

PRIOR ART

CONTAINER WITH RELEASABLE CLOSURE

The present invention relates to containers and particularly, although not exclusively, to containers for carbonated beverages.

It is known to provide containers, e.g., cans, for carbonated beverages which comprise a manually releasable closure whereby access can readily be had to the contents of the container without the need to use a can opener or other tool.

One well-known closure for a beverage can comprises a closure member defined by partially cutting through the metal of the can and having a pull ring attached thereto whereby the closure member can be torn out of the metal of the can. Such closure members are generally provided in an end wall of the can and have the disadvantages that at least the end wall of the can in which the closure is provided must be formed from a readily tearable and relatively expensive metal such as aluminium or aluminium alloy and that when removed from the can the closure member is frequently simply thrown away and so creates a litter problem.

Another known type of closure for beverage cans is of the press-open kind such as is disclosed in U.S. Pat. Nos. 2,261,117 and 3,931,909 and comprises an opening formed in an end wall of the can by partially severing a portion therefrom so as to leave said portion attached to the can end wall by an integral hinge portion and forming a closure member from said severed portion which is larger than and closes said opening. Such a closure has the advantages that no special metal is required for the can end in which it is formed and that the closure member is not removed from the can when the can is opened and accordingly does not create a litter problem. However, to open such a closure it is necessary to push the closure member downwardly into the can with the result that a possibly dirt contaminated outer surface of the can intrudes into the can and comes into contact with a beverage poured through the opening, that the user's finger intrudes into the can when the closure member is pushed downwardly, which is not only unhygienic but also brings the user's finger into contact with the metal edge defining said opening, and that the closure member extending downwardly into the can interferes with the flow of beverage through the opening.

The present invention has as its object to provide a container having a manually releasable closure which has all of the advantages of the press-open kind without the disadvantages thereof.

The present invention provides a container including a sheet metal wall portion having a closure formed therein, the closure comprising a slit in the wall portion the margins of the slit cold work formed to overlap for closing a passage defined between the overlapping surfaces, a leakproof seal made between the overlapping surfaces, a part of the wall portion formed deformable by manual pressure application at a point remote from the passage when closed or fully opened and in communication with the overlap to move at least one overlapping surface apart and break the seal for opening the passage when said pressure is applied.

Embodiments of the invention will now be described by way of example, reference being made to the accompanying drawings in which:

FIGS. 22 to 27 are as for English speaking countries.

Figure 1:
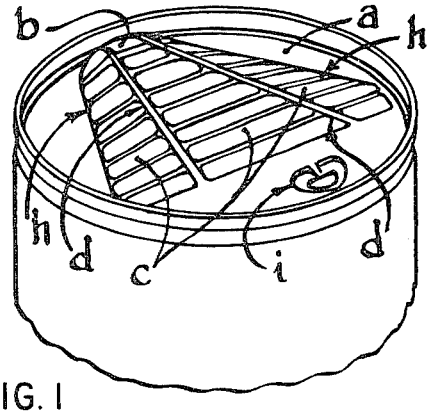
FIG. 1 shows a preferred embodiment of the invention in the closed state.
Figure 2:
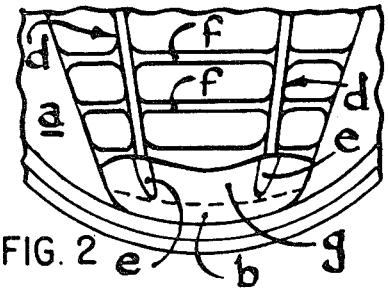
FIG. 2 is a partial end view of the pouring spout, shown by FIG. 1, in plan, as seen in the open or closed state.
Figure 3:
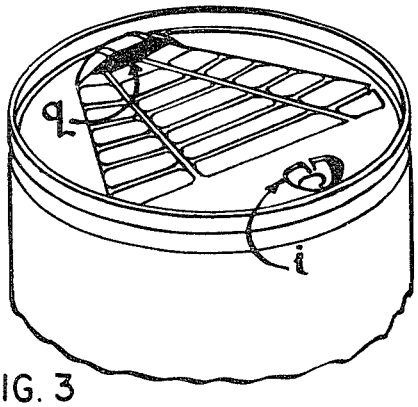
FIG. 3 shows the embodiment shown by FIG. 1 in the opened state.

All embodiments of the invention described with reference to the drawings are examples wherein a closure is formed within the can end of a beverage can; however it will be understood that if desired the closure may be formed in any other suitable container wall part. The same parts have been indicated by the same reference letters throughout the drawings. FIGS. 1, 2 and 3 show the inner disc surface portion (a) of a can end formed at one side into a part hemispherical spout (b) with an inner facing side opening (q) toward a raised deformable wall (c) of the disc portion (a) diverging between fold lines (h) and diminishing in height away from the spout toward a pressure release valve and vent opening (i) closed by a flap (k). The deformable wall (c) is divided by ribs (d) formed from the disc and which, with fold lines (h), serve to divide the wall (c) into three elongate panelsresistance is carried forward into the area (g) overlapped by spout (b). Spout (b) is shown in FIG. 2 to have caps (e) for accommodating the ends of the stiffening ribs (d). The panels of wall (c) are stiffened laterally by ribs (f). A sealant material is introduced between the overlapping surfaces of area (g) and spout (b), to seal the closure.

Figure 4:
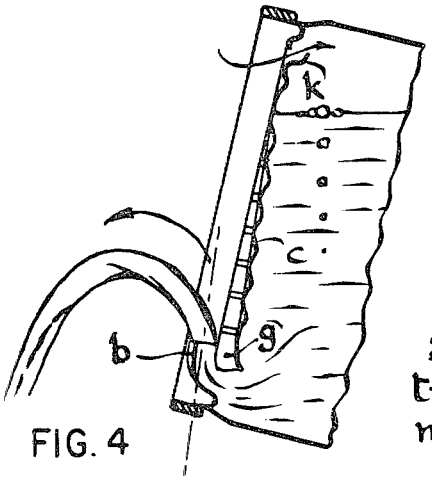
FIG. 4 shows a section through the centre line of the container shown by FIG. 3, dispensing liquid.

To open the closure, the pressure release valve is first opened by pressing open flap (k) and because the area thereof is small and therefore subject to a relatively small internal pressure, this may be done with the finger. After the internal pressure is relieved, finger pressure on the central panel of wall (c) will cause compressive stressing of the ribs (f) which will exert outward pressure on the disc portion (a) until wall (c) yields and pops inwardly due to the high pressure resulting from the lever action afforded by ribs (f) which are positioned at a shallow angle with respect to one another when seen in section cut across ribs (d). Upon yielding the panels of wall (c) will assume a similar shape in reverse, as best seen in FIG. 3, thus providing an opening (q) for the passage of liquid from the can between the reversed inside surface (g) of wall (c) and the inside of the spout (b) when the can is tilted as shown in FIG. 4. As liquid is poured out of the can air will flow into the can through opening (i) shown in FIG. 1 to replace the volume of liquid poured from the can. The axis of liquid flow through the spout (b) is upward and at that point is substantially parallel to the disc portion (a), but because the flow is supplied from the can side of the opening the flow is diverted away from the supply as a fountain, upward and away from the can. The outflow from the can is governed by the capacity of the opening (i) as well as by the opening (q) and therefore it is important that these openings are matched to one another and to the viscosity of the liquid.

Figure 5:
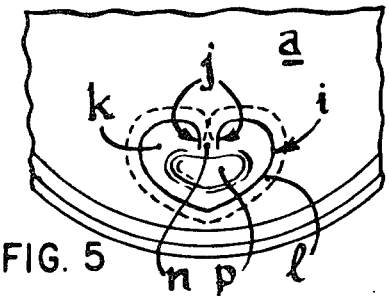
FIG. 5 is a partial end view of one form of a vent of the invention in plan view.
Figure 6:
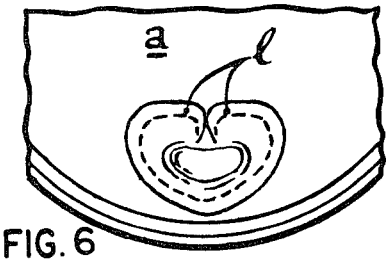
FIG. 6 shows the partial end view of FIG. 5 seen from below.
Figure 7:
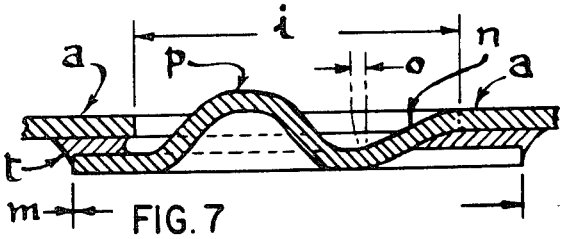
FIG. 7 shows the vent shown by FIG. 5 and FIG. 6 seen as a section centrally through FIGS. 5 and 6 in line.

A suitable venting means is shown in FIGS. 5, 6 and 7. In known closures of the press in type, used for both pouring and venting separately, an area of metal is raised, the area is cut around by a noncontinuous line of cut so as to leave it attached at one side by an integral hinge, and the area raised is then reduced to cause it to expand and overlap the opening formed by the line of cut. Because said area is expanded radially outwards from the hinge, there can be no overlap immediately on each side of the hinge and accordingly there is a line of weakness for possible rupture on either side of the hinge which requires special control in production. The venting means illustrated in FIGS. 5 to 7 is such that the overlap does not diminish in the aforementioned manner at the ends of the cut. The venting flap (k) FIG. 5, is similar to the prior art except that the ends (j) of the line of cut are extended substantially parallel to one another into the area of the flap (k) to define a neck portion (n). Thus, when the flap (k) is spread the spread will be radial from that area surrounding the ends of the cut (j) and will result in an area (1) overlapping disc portion (a) around the opening (i) because the diminishing areas of overlap at each end will be one toward the other over the neck portion (n) which forms an elongated hinge attachment with disc portion (a) and which through being elongated will be better able to resist breakage on bending, as seen from within the container FIG. 6. Sealant material is entered between the overlap to seal it and make it responsive to internal pressure as a valve with a leakproof seal (t) at the valve interface.

FIG. 7 shows the vent means in section. It will be seen that the object of completely surrounding the flap (k) by overlap area (1) can also be achieved by drawing the flap (k) toward that side of opening (i) to which the hinge neck (n) is attached to centralise the width (m) of the flap (k) with opening (i). FIG. 7 shows the flap (k) lower than its level of origin and as the length of neck (n) has not changed, yet it has been moved radially downward and has been measurably displaced (o) laterally toward the point of connection with disc (a) to advantage. A prominent part (p) of flap (k) is provided for the application of finger pressure to displace the flap (k) into the container. However, the size of flap (k) and opening (i) is such that the finger cannot enter into the can.

Figure 8:
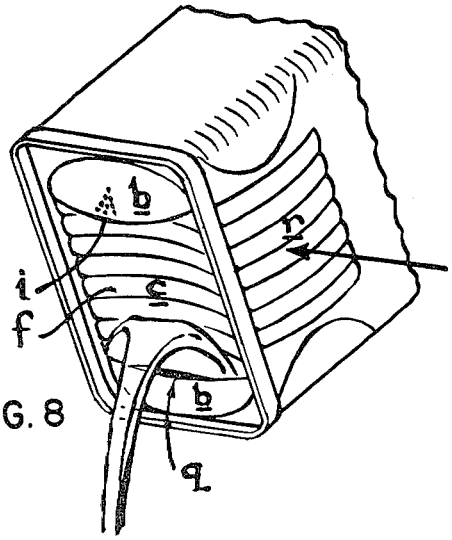
FIG. 8 shows a reclosable embodiment of the invention dispensing liquid from a container.

FIG. 8 shows a further embodiment of the invention in the form of a reclosable container. In this embodiment two pouring spouts (b) are provided one of which will serve for pouring and the other for venting and which are interchangeable one with the other. In FIG. 8 the pouring spout and vent are raised at each end of a rectangular metal can end wall with openings (q) facing one toward the other over a cooperating deformable wall (c) which is formed with transverse ribs (f). The deformable wall (c) is overlapped at each of its free ends by spout (b) so as to close the opening (q). Upon indentation to displace deformable wall (c) the overlapping surfaces of portion (c) and spout (b) will be moved apart to define therebetween passage (q) and vent opening (i). A ribbed wall portion (r) is provided which functions as an extension of the wall (c) by virtue of their being joined together by an intermediate seam and upon identation of wall portion (r), as directed by the arrow in FIG. 8, the stress bearing in the wall (c) will change and cause it to revert to its original closed position where it will again overlap with the spout (b) and reestablish a seal therebetween to re-close the container.

Figure 9:
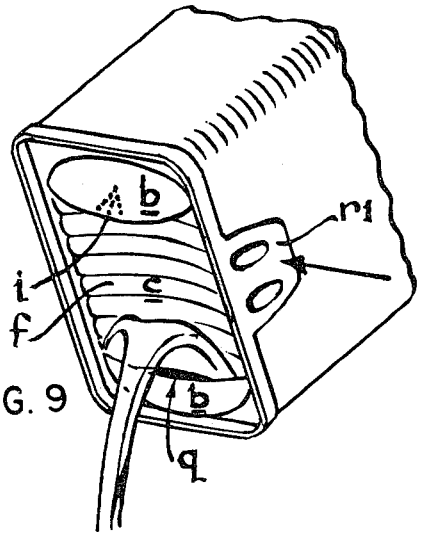
FIG. 9 shows another reclosable embodiment of the invention dispensing liquid from a container.

The embodiment of FIG. 9 is similar to the embodiment of FIG. 8 except that the ribbed wall portion (r) is replaced by a flap extension ($r^1$) integral with portion (c) and overlying the adjacent side wall of the can. Although the embodiments shown by FIGS. 8 and 9 will operate with only one portion (r) or ($r^1$) it is preferred that a similar portion (r) or ($r^1$) will also be provided on or over the opposite side wall of the can. In the FIG. 9 embodiment it is intended that wall (c) will be indented by digital pressure but if desired the stress bearing in wall (c) could be changed by pulling the extension ($r^1$) away from the container to displace wall (c).

Figure 10:
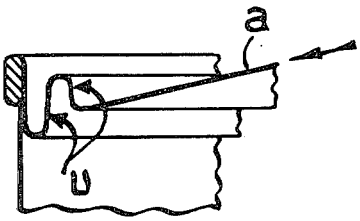
FIG. 10 shows a method according to the invention allowing compressibility for wall displacement, in section.

Although it is not essential to the operation of the invention it is helpful if the cooperating deformable wall (c) has imparted thereto characteristics of stiffness, hingeability and/or compressibility so that the deformable portion (c) will deform in a predetermined manner to open the passage (q). From FIGS. 1 to 4 it has already been shown that hingeability can be achieved between the panels of wall (c) by means of ribs (d), longitudinal stiffness by ribs (d) and lateral stiffness by ribs (f). FIG. 10 shows that compressibility, for wall disc (a) for instance, can be achieved by folding the material of wall portion (a) into corrugations such that parts (u) of each corrugation are perpendicular to the direction of the compressing force shown by the arrow.

Figure 11:
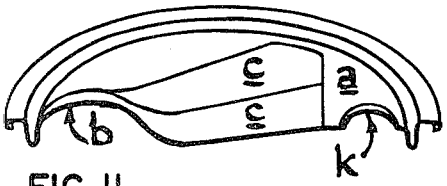
FIGS. 11 to 14 shows stages in a method for producing the embodiment shown by FIGS. 1 to 7.
Figure 12:
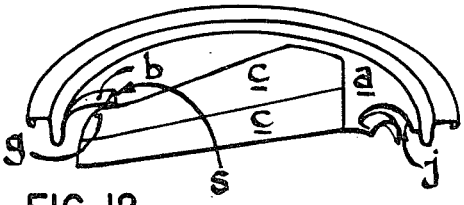
Figure 13:
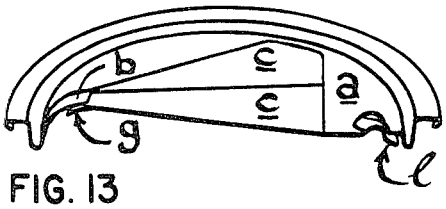
Figure 14:
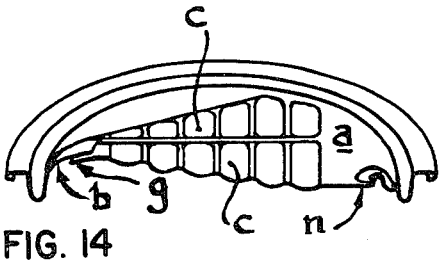

FIG. 11 shows a metal can end for the embodiment of FIGS. 1 to 7 at an early stage in its manufacture. The metal can has been cold worked to raise an area from which spout (b) will be formed and to indent an area from which portion (c) will be formed so that there is a greater length of material in these areas than will ultimately be required. An area for forming vent flap (k)

has also been raised. FIG. 12 shows the can end at a later stage in production where spout (b) and wall (c) have been separated by a slit (s) and the above-mentioned greater length of material has been pressed toward spout (b) and in line with the wall (c) to produce the overlap area (g) which is overlapped by spout (b). It will be seen that when produced as shown the ends of the overlap area (g) adjoining the ends of the slit (s) do not diminish as in the case of the press-open type flap openings of the prior art which have a defined opening area prior to opening as previously described. The raised area for flap (k) of the vent has been cut around at (j) as previously described. FIG. 13 shows the can end at a yet later stage in production where deformable wall (c) has been raised so that the area (g) forms a closed overlap with spout (b). The flap (k) of the vent is seen spread to form the overlap (1). FIG. 14 shows the can end at a still later stage in production where the wall (c) has been embossed with ribs (f) and ribs (d) and the vent flap (k) has been closed against disc (a). After the above cold working of material to form the can end, a suitably frangible sealing material such as that sold under the Trade Mark Plastisol is introduced into the gap between the overlapping surfaces of area (g) and spout (b) and between the flap (k) and disc portion (a) which gap is necessarily present due to the inherent elasticity of the materials of the can end. However it will be understood that some suitable materials, such as plastics coated metal, are inherently capable of providing a frangible leakproof seal, for instance by interface embedment of the material under heat and pressure in which case the said sealing material will not be required.

Figure 15:
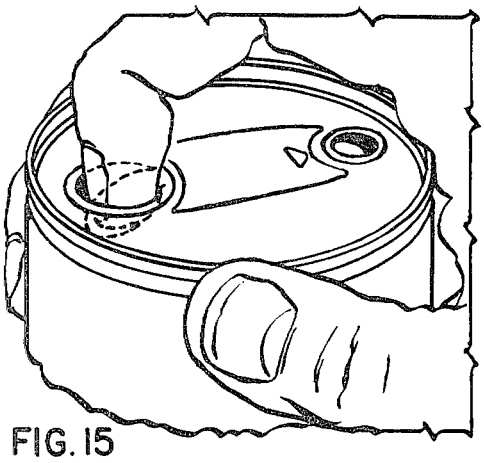
FIG. 15 shows the method for opening a beverage can made according to prior art, seen in perspective.

FIG. 15 shows a press-open type closure of a prior art form previously described and having the disadvantage that the overlap diminishes on each side of the hinge portion and that whereas the small vent opening on the right of the figure need not be opened completely, the larger flap opening on the left of the figure must be opened at least to the degree shown if the flap is not to obstruct flow through the opening, which means that the user's finger must enter the can and this, like the outside of the flap, may not be clean and dirt or the like may contaminate a beverage poured from the can.

Figure 16:
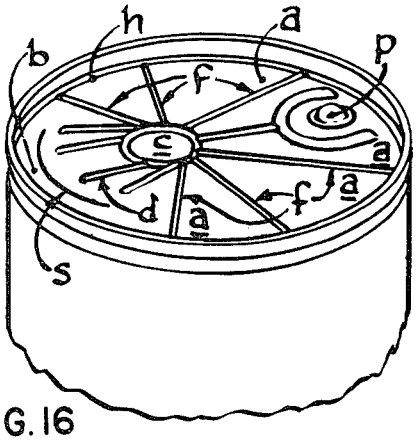
FIG. 16 shows an embodiment of the invention in the convex closed state.
Figure 17:
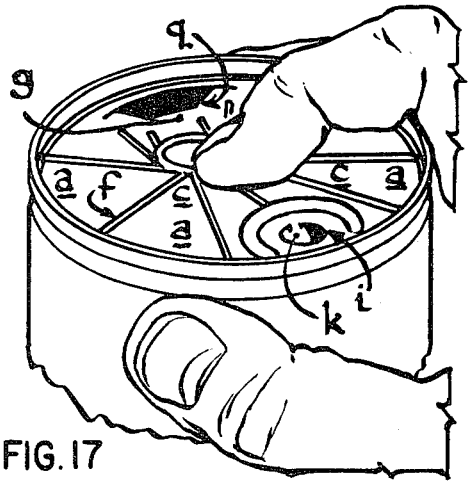
FIG. 17 shows the embodiment shown by FIG. 16 in the concave opened state.

In the embodiment of FIGS. 16 and 17 a different arrangement of stiffening ribs (d) and (f) is shown. The embodiment of FIG. 16, like all embodiments of the invention, is controlled in its opening to give a predetermined opening (q) after vent opening flap (p) has been pressed inwardly to release internal pressure and a central area of deformable wall (c), remote from slit (s) has been pressed inwardly to open passage (q) as shown in FIG. 17. Prior to opening of the vent, the whole of wall (c) is subject to the internal pressure within the container which not only provides a strong resistance to accidental opening but also provides a seal strength proportional to the pressure within the can because spout (b) is located close to the periphery of disc (a) and is therefore more resistant to deflection while offering less area to the internal pressure. Thus, the greater the pressure within the can, the greater the pressure of overlap area (g) against the spout (b). In this way all embodiments operate as an efficient one-way valve until opened.

Figure 19:
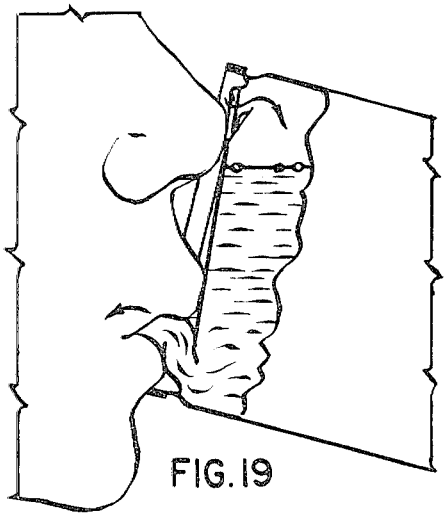
FIG. 19 shows the embodiment shown by FIG. 4 in another drinking mode.
Figure 18:
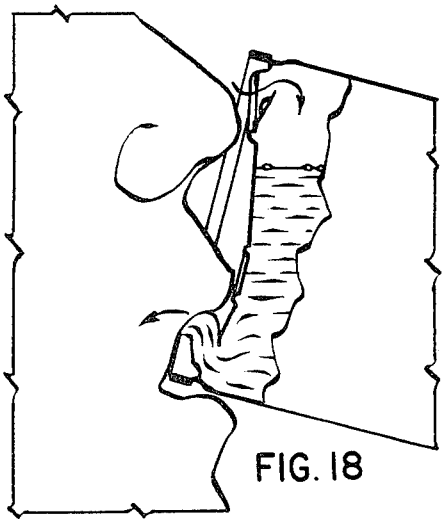
FIG. 18 shows the embodiment shown by FIG. 17 in a drinking mode.
Figure 22:
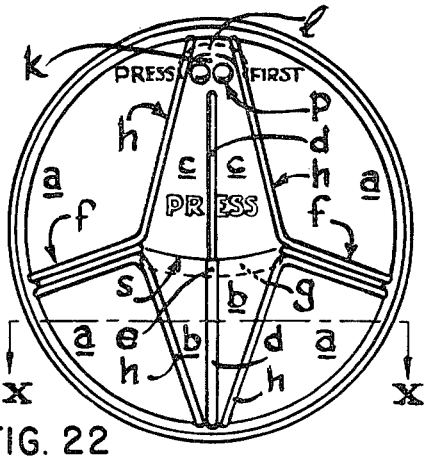
FIG. 22 shows an embodiment of the invention where opening of the vent and pouring spout is combined, seen in plan view.
Figure 27:
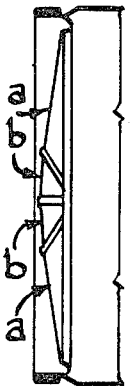
FIG. 27 is a section cut on the line X—X of FIG. 22 showing the relative angles of the walls.
Figure 23:
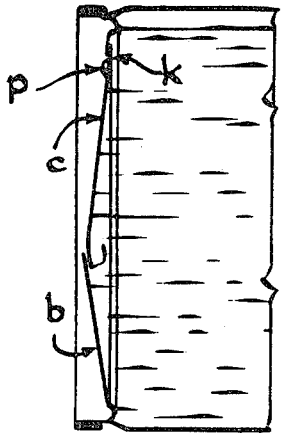
FIG. 23 shows a sectional cut through the centre line of the container shown by FIG. 22 in the closed state.

FIG. 18 shows drinking directly from the can illustrated in FIG. 17, while FIG. 19 illustrates another mode of drinking directly from the can shown in FIG. 4. Both modes are a matter of preference and are interchangable although an opening nearer the centre of the can will be more appropriate to FIG. 19 than FIG. 18.

Figure 20:
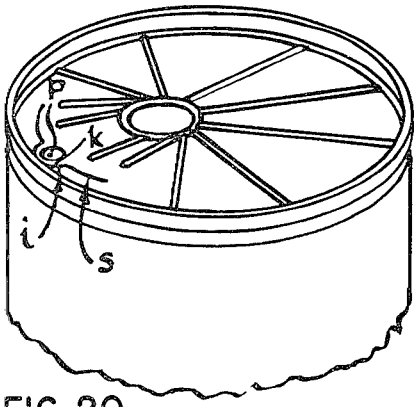
FIG. 20 shows an embodiment of the invention where pressure release means is included in the pouring spout.

FIG. 20 shows a similar embodiment to FIG. 16 except that slit (s) includes a vent opening (i) in its length which is covered by a flap extension (k) of the overlap area (g) and which can be bent inward sufficiently, against a small area for internal resistance relative to that holding slit (s) closed, to be able to release the internal pressure. However it does not include any vent in a position which is separated from the point for pouring sufficiently for easy use.

Figure 24:
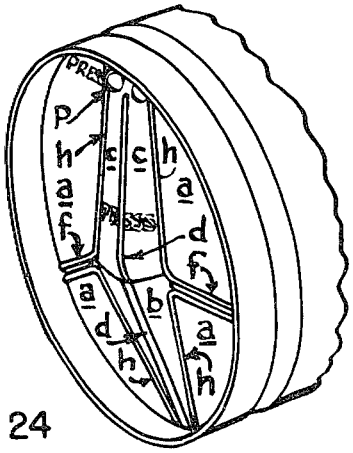
FIG. 24 is a perspective view of the container as shown by FIG. 23.
Figure 25:
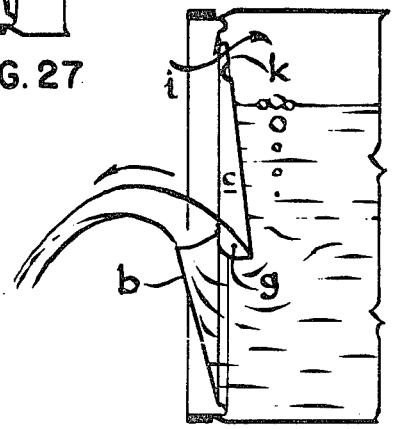
FIG. 25 shows a sectional cut through the centre line of the container shown by FIG. 22 in the opened state.
Figure 26:
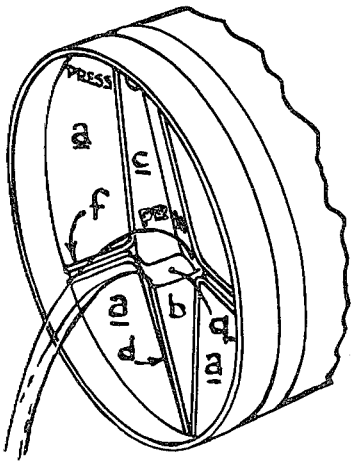
FIG. 26 is a perspective view of the container as shown by FIG. 25.
Figure 21:
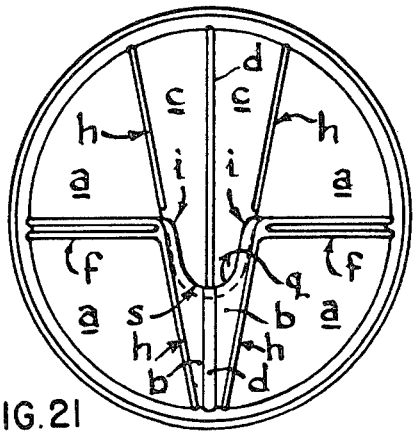
FIG. 21 shows an embodiment of the invention where venting means is inclined in the pouring spout.

FIG. 21 shows an embodiment having a similar slit (s) but in the form of a "U" cut. The slit (s) will allow pouring from its lower part (q) while air is free to enter on each side (i) above the outflow of liquid. FIG. 21 has a pouring spout formed according to the embodiment shown in FIGS. 22 to 27. FIGS. 22, 23, 24 and 27 show the can closed and FIGS. 25 and 26 show it opened. FIGS. 24 and 26 have their axial dimensions exaggerated for better understanding. To open the can the prominent area (p) is first pressed inward to relieve the internal pressure between the "U" shaped overlap (l). This will enable deforming wall (c), divided by rib (d) and in cooperation with the overlapped area (g), to be pressed inwardly with a finger to cause further opening at (l) by the cooperation of deforming wall (c) with flap (k) to form vent (i) and cause some opening at (q). It will be seen from FIG. 27 that the angle of the wall of spout (b) is shallow in relation to disc (a) and the angle of deforming wall (c) is similarly shallow in relation to disc (a) so that indentation of wall (c) requires an acceptable force and further pressure inward and applied to wall (c) will displace lever ribs (f), through fold connections (h), such that a small inward displacement pressure on wall (c) will cause end pressure at slit (s) from ribs (f) which when displaced radially will lengthen as viewed in FIG. 22 and squeeze the walls of spout (b) to erect outwardly to form the spout (b) and further deflect the walls of (c) inwardly to increase the passage opening between area (g) and spout (b), as well as further opening vent (i). Theoretically the disc (a), when indented, will assume an angle to the horizontal line of the closure similar to that when closed but in practice the stress caused within the closure and which would otherwise cause it to so revert, can be absorbed by means such as one or more corrugations as described in FIG. 10, which will increase the stiffness of levers (f) but make them laterally compressible. Therefore FIGS. 25 and 26 show the disc portion (a) and lever ribs (f) in the normal plane of the can end.

It is desirable to balance the design against the material from which the can end is formed to obtain a snap-action upon opening of the closure after portion (c) has been displaced beyond the dead centre of the lever components of wall (c). Such levers are three in the case of the embodiment of FIGS. 1 to 4, continuous in the embodiment of FIGS. 8 and 9 as a series of bows in one direction, bow-like again in the embodiment of FIGS. 16 and 17 but radial with all the bows meeting centrally, while the levers of the embodiments of FIGS. 21 to 26 are more complicated compound arrangements. However, in each case the displacement of the wall (c) will place it into stress up to the point where theoretically, it has been displaced to half of its capacity for displacement, thus providing a controllable degree of snap-action opening.

The dispensation of liquid from the embodiments of the invention described is superior to those of the prior art because the embodiments of the invention pour across an edge of metal which has no surface for the liquid to cling to and, as is well known from the theory of Henri Coanda, fluids tend to attach themselves to a surface over which they pass and cling to it. Therefore flow from the prior art forms can easily attach itself to the wall which is below and perpendicular to the desired line of flow due to the absence of any other surface, whereas according to the present invention flow is directed along the inner surface of spout (b) and will depart from its edge cleanly rather than double back on itself. Therefore the present invention is able to adapt the beverage can to the performance of the well known coffee-pot. Also it is more hygienic than prior art forms because the drink does not contact an outside contaminated surface of the container. Also it is cheaper than the detachable Pull-tab closure for cans by the absence of the extra tab and said lack of detachment allows it to comply with legislation in force in some countries banning such detachment. Furthermore it can be cheaper because it can be made from steel whereas prescored openings must be made from aluminium and this again makes the container of the present invention ecologically more acceptable because if the beverage can is made from steel alone it may be reclaimed, whereas when it is made from aluminium and steel it becomes waste in need of disposal.

I claim:

1. A metal end cover for a container comprising a wall portion divided by a slit opening into a moveable actuating underlap part and a substantially static overlap part, the static overlap part overlapping the underlap actuating part at the margins of the slit opening and the overlap being closed with the underlap to form an overlapped edge leakproof seal; said end cover being further characterised in that the underlap actuating part includes an indentable actuating area remote from the area defined by the overlapped edge seal and not contacted by fluid flowing from a container closed by the cover after opening of the overlapped edge seal, said indentable actuating area being located on a line that intersects a line joining the ends of the slit in a direction away from the overlapped edge seal and being stiff in construction and able to transmit to the underlap part of the overlapped edge seal along the said intersecting line a seal separating force applied to the indentable actuating area, the application of external force at said indentable actuating area serving to break open the seal and form a substantially tubular passageway through the slit opening between the overlapping margins of said overlap static and underlap moveable actuating parts for directing fluid flow out from a container closed by the end cover in a spout-like manner.

2. A metal end cover as claimed in claim 1 for a container of pressurised fluid providing internal force wherein the inner area of the moveable actuating part is greater and acted upon by more of said pressure than the inner area of the fixed part.

3. A metal end cover as claimed in claim 1 wherein the container or end cover includes venting means for venting the container at a point different from the slit opening.

4. A metal end cover as claimed in claim 1 further including a sealant interposed between the overlapping margins of the static and actuating parts that form the overlapped edge leakproof seal.

5. A metal end cover as claimed in claim 1 wherein the actuating part is formed raised in the closed condition and indented toward the container in the open tubular passage forming condition.

6. A metal end cover as claimed in claim 2 wherein the container or end cover includes venting means for venting the container at a point different from the slit opening.

7. A metal end cover as claimed in claim 6 further including a sealant interposed between the overlapping margins of the static and actuating parts that form the overlapped edge leakproof seal.

8. A metal end cover as claimed in claim 7 wherein the actuating part is formed raised in the closed condition and indented toward the container in the open tubular passage forming condition.

9. A metal end cover for a container according to claim 1 or 3 wherein definition and deformation of the moveable actuating part is predetermined by provision of stiffening ribs, hingeability axial to creasing, compressibility at corrugation, and captivity by a rim in any combination or arrangement.

10. A metal end cover for a container according to claim 1 wherein the overlapped edge seal is so formed that upon said moveable actuating part being indented to move the overlapping edges apart and open the slit opening a pouring spout mouth inherently is provided.

11. A metal end cover for a container according to either of claims 1, 8 or 10 wherein at least one of said overlapping static and moveable actuating parts defining the slit opening is formed as a spout mouth able to take advantage of the inclination of flowing liquid to cling to the surface to which it has become attached and thereafter depart from the surface cleanly in a spout-like manner through flow being planar to the spout mouth.

12. A metal end cover for a container according to claim 10 further including venting means openable for venting a container on which the end cover is used.

13. A metal end cover for a container according to claim 12 wherein the external force applied to said indentable actuating area also is applied to a vent opening for opening it.

14. A metal end cover for a container according to claim 8 wherein definition and deformation of the moveable actuating part is predetermined by provision of stiffening ribs, hingeability axial to creasing, compressibility at corrugation, and captivity by a rim in any combination or arrangement.

15. A metal end cover for a container according to either of claims 1, 8, 10 or 14 wherein said moveable actuating part is reclosable.

16. A container having an end cover constructed according to either of claims 1, 8, 10 or 14.

17. A metal end cover for a container according to either of claims 1, 8, 10 or 14 wherein a part of the moveable actuating part which is indentable to open the overlapped edge seal is so formed that it can be sprung between a position in which the slit opening is closed and a position in which the slit opening is open.

18. A metal end cover for a container according to claim 1, 8, 10 or 14 wherein the end cover is so formed that manual pressure on a predetermined part of a container wall with which the cover is used adjacent said cover after the slit opening has been opened will cause the moveable actuating part of the cover to be sprung to a position in which the slit opening is closed.

19. A metal end cover for a container according to either of claims 1, 8 or 14 wherein the moveable actuating part has an extension which overlies an adjacent part of the container on which the cover is used, said extension being capable of opening or closing the slit opening upon the application of a force thereto in the right direction.

20. A metal end cover for a container according to claim 14 wherein the end cover includes overlapping edge seal means separate from the slit opening for venting a container with which the end cover is used.

21. A metal end cover for a container according to claim 1 wherein said cover further includes vent means for venting a container with which the cover is used, said vent means comprising a second small opening in said end cover which is smaller than a human finger and a separate closure member which closes said second small opening and moveable by manual pressure, said closure member comprising a part of the end cover which has been cut to form said small opening, the end cover portion around said small opening and the closure member having been so formed that the end cover portion overlaps a margin of the closure member with a leakproof seal therebetween and with the closure member not being completely severed from the end cover portion surrounding the small opening but remains connected thereto by an integral hinge portion.

22. A metal end cover for a container according to claim 21 wherein the ends of the line of cut defining said small vent opening are substantially parallel on each side of the hinge portion to define a neck connecting the closure member to the end cover, said neck being overlapped on each side thereof and said closure member being extended parallel to and below its original plane to underlap the surrounding marginal edge of the end cover and the connecting neck moved radially.

23. A metal end cover for a container according to claim 14 wherein said vent means is integral with said slit opening closed by said overlapped edge seal and wherein the slit opening is so formed that upon a container closed by the cover being opened and tilted to a pouring position, the slit opening will comprise a lower pouring spout portion and a upper vent portion.

24. A container for containing carbonated beverages having a cover constructed according to either of claims 20–23.

* * * * *